United States Patent [19]

Paraskos et al.

[11] 4,053,391

[45] Oct. 11, 1977

[54] HYDRODESULFURIZATION PROCESS EMPLOYING A GUARD CHAMBER

[75] Inventors: John Angelo Paraskos, Pittsburgh; Stephen Joseph Yanik, Valencia, both of Pa.

[73] Assignee: Gulf Research & Development Company, Pittsburgh, Pa.

[21] Appl. No.: 632,357

[22] Filed: Nov. 17, 1975

[51] Int. Cl.[2] ..... C10G 23/02

[52] U.S. Cl. ..... 208/210; 208/251 H

[58] Field of Search ..... 208/210, 216, 212, 209, 208/304

[56] References Cited

U.S. PATENT DOCUMENTS

| | | | |
|---|---|---|---|
| 3,530,066 | 9/1970 | Kuwata et al. | 208/210 |
| 3,563,886 | 2/1971 | Carlson et al. | 208/210 |
| 3,563,887 | 2/1971 | Fraser et al. | 208/216 |
| 3,702,238 | 11/1972 | Armistead et al. | 208/216 |
| 3,795,607 | 3/1974 | Adams et al. | 208/210 |
| 3,809,644 | 5/1974 | Johnson et al. | 208/210 |
| B501,317 | 1/1976 | Milstein | 208/210 |

*Primary Examiner*—George Crasanakis

[57] ABSTRACT

A process for hydrodesulfurizing a residual oil by passing the oil downwardly through a catalytic reaction zone at a hydrogen pressure which is sufficiently high that demetallization occurs rapidly so that at end-of-run the upstream catalyst region is more nearly metals-saturated than the downstream catalyst region. At the end of the catalyst cycle, the more nearly metals-saturated upstream portion of the catalyst is removed from the process while the less nearly metals-saturated downstream portion of the catalyst is passed to a guard chamber where during further operation of the process it approaches metals-saturation. In this manner, no portion of catalyst is removed from the process until it has an elevated metals content.

6 Claims, 5 Drawing Figures

Figure 1:
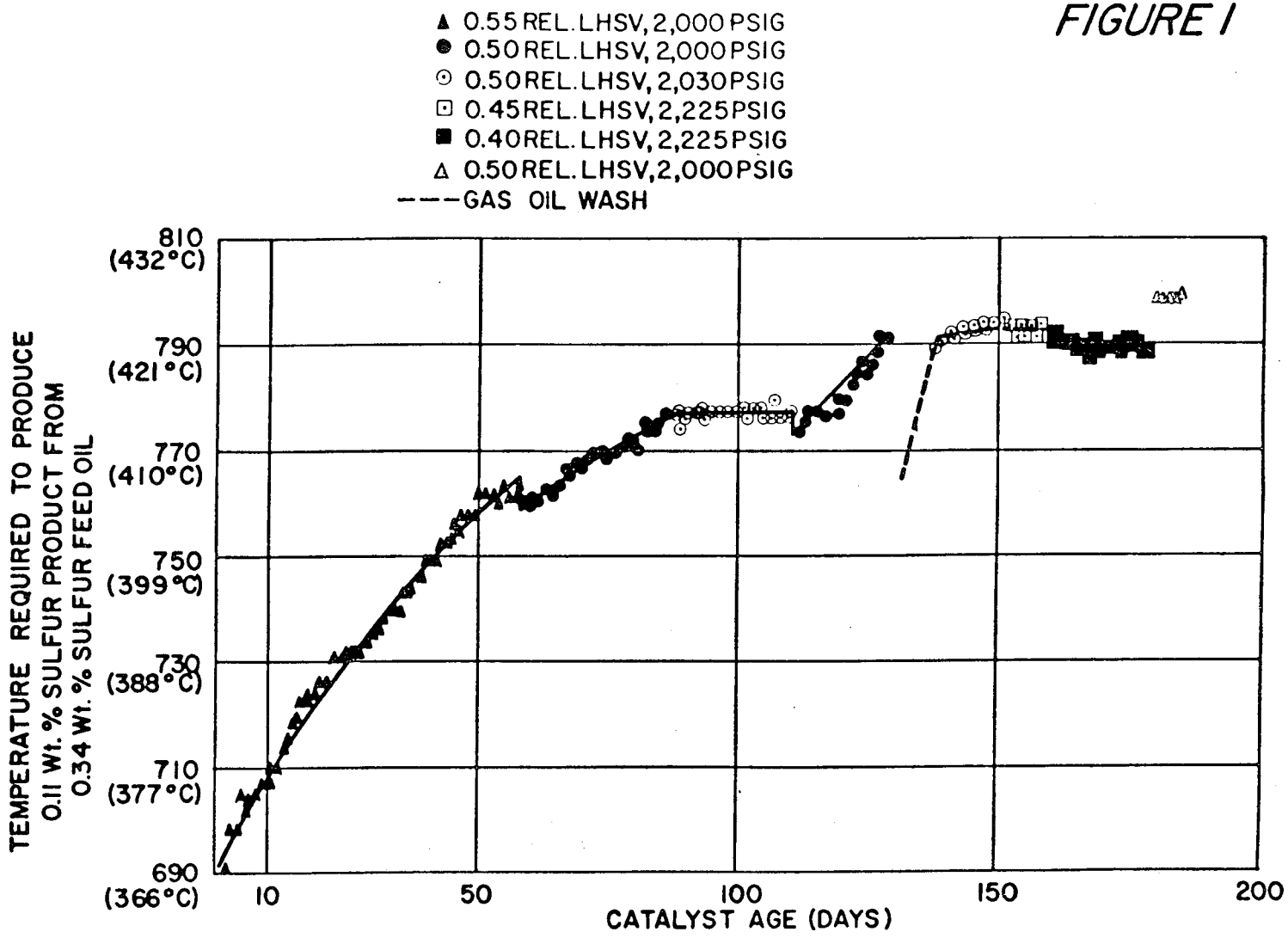

FEED TO THIRD STAGE
DESULFURIZED RESIDUAL OIL
CONTAINING 0.3% S.
FEED TO THIRD STAGE
NON-DESULFURIZED
RESIDUAL OIL
CONTAINING 4% S.
1.0 REL. LHSV
0.5 REL. LHSV
0.35 REL. LHSV
DMS ADDITION
H2S CIRCULATION
TOTAL LIQUID PRODUCT
SULFUR CONTENT: Wt. %
1.1
1.0
.9
.8
.7
.6
.5
.4
.3
.2
.1
0
REACTOR TEMPERATURE: °F
780 (416°C)
770 (410°C)
760 (404°C)
750 (399°C)
1 2 3 4 5 6 7 8 9 10 11 12 13 14 15 16 17 18 19 20 21 22 23 24
CATALYST AGE (DAYS)

HYDRODESULFURIZATION PROCESS EMPLOYING A GUARD CHAMBER

This invention relates to a process for the hydrodesulfurization of metal- and sulfur-containing asphaltenic heavy oils.

The present process relates to hydrodesulfurization of a residual oil by passing the oil downwardly through both a guard chamber and a catalytic reaction zone in series at a pressure which is sufficiently high that demetallization occurs so rapidly that at end-of-run the upstream catalyst region in the reaction zone is more nearly metals-saturated than the downstream catalyst region. At the end of the catalyst cycle, the more nearly metals-saturated upstream portion of the catalyst in the reaction zone is removed from the process while the less nearly metals-saturated downstream portion is used as refill catalyst for the guard chamber where, during further operations of the process, it approaches metals-saturation. In this manner, all portions of the catalyst are utilized in the process until a high metals level is achieved. Also, it is shown below that removal of the downstream portion of the catalyst to the guard chamber is likely to reduce the coke level on that portion of the catalyst.

The present process employs a supported Group VI-B and Group VIII metal hydrodesulfurization catalyst. One or more metals from other groups can also be present, such as titanium. Suitable Group VI-B and Group VIII metal combinations include cobalt-molybdenum, nickel-tungsten and nickel-molybdenum. A preferred combination is nickel-cobalt-molybdenum. The catalyst can comprise 5 to 30 weight percent generally, and 8 to 20 weight percent, preferably, of Group VI-B and Group VIII metals. The remainder of the catalyst generally comprises a highly porous, non-cracking supporting material. Alumina is the preferred supporting material but other porous non-cracking supports can be employed, such as silica-alumina and silica-magnesia. Preferably all or a large proportion of the catalyst particles have a diameter between about 0.025 and 0.05 inch (0.0635 to 0.127 cm), and can be in any suitable shape, such as extrudates, granules or spheres. Whatever the particle shape, diameter is defined as the smallest surface-to-surface dimension of a catalyst particle extending through the center or axis of the particle.

In the present process, the feed oil flows downwardly in the reactor and guard chamber through a fixed bed of the catalyst. Although a single reactor can be employed to remove 60, 70, 80 or more weight percent of the feed metals and sulfur from the oil, two or more reactors in series can be employed. Very little hydrocracking occurs in the process. Most of the product oil boils above the initial boiling point of the feed oil, generally, and preferably at least 70, 80 or 90 percent of the total product boils above the IBP of the feed oil.

The hydrodesulfurization process employs a hydrogen partial pressure of 500 to 5,000 pounds per square inch gauge (35 to 350 kg/cm$^2$), generally, 1,000 to 3,000 pounds per square inch (70 to 210 kg/cm$^2$), preferably, and 1,500 to 2,500 pounds per square inch (105 to 175 kg/cm$^2$), most preferably.

The gas circulation rate can be between 1,000 and 20,000 standard cubic feet per barrel of oil (17.8 and 356 SCM/100L), generally, or preferably about 2,000 to 10,000 standard cubic feet per barrel of oil (35.6 to 178 SCM/100L). The gas circulated preferably contains 80 percent or more of hydrogen. The mol ratio of hydrogen to oil can be between about 4:1 and 80:1. Reactor temperatures can vary between about 600° and 900° F. (316° and 482° C.), generally, and between 650° and 800° F. (343° and 427° C.), preferably. Reactor temperatures in the reaction zone are increased during a catalyst cycle to compensate for activity aging loss until a reactor constraint temperature is reached, at which time the catalyst is considered deactivated. The temperature in the reaction zone should be sufficiently low so that not more than 30 percent, generally, and preferably not more than about 10, 15 or 20 percent of the 650° F.+ (343° C.+) feed oil will be cracked to material boiling below 650° F. (343° C.). The liquid hourly space velocity in each reactor can be between about 0.1 and 10, generally, and, preferably, between about 0.2 and 1 or 1.25 volumes of oil per hour per volume of catalyst.

The fresh feed to the process of this invention can be a full petroleum crude or a reduced crude containing substantially all of the residual asphaltenes of the full crude. The process is also useful for desulfurizing and demetallizing other asphaltene-containing oils, such as coal liquids and oils extracted from shale and tar sands. Asphaltenes have a relatively low molecular hydrogen to carbon ratio and will generally comprise less than about 10 percent of the feed oil, but will generally contain most of the metallic components present in the total feed, such as nickel and vanadium.

Petroleum atmospheric or vacuum tower residua contain substantially the entire asphaltene fraction of the crude from which they are derived and therefore contain 95 to 99 weight percent or more of the nickel and vanadium content of the full crude. The nickel, vanadium and sulfur content of petroleum residua can vary over a wide range. For example, nickel and vanadium can comprise 0.002 to 0.03 weight percent (20 to 300 parts per million) or more of the residua, while sulfur can comprise about 2 to 7 weight percent, or more, of the residua.

The desulfurization catalysts have a high activity for demetallization as well as for desulfurization and the catalyst removes most of the nickel and vanadium from the feed oil stock as well as most of the sulfur. These metals deposit heavily on the outermost regions of the catalyst particles and tend to inhibit access to catalyst pores, thereby reducing the desulfurization activity of the catalyst. Upon blockage of the pores, the aging rate of the catalyst ceases to be gradual and increases abruptly to terminate the catalyst cycle. Therefore, removed nickel and vanadium generally account for the ultimate deactivation of first stage desulfurization catalysts, while coke deposition during removal of sulfur and nitrogen contributes relatively little to catalyst deactivation in the first stage. A metals deactivated catalyst is not regenerable by known commercial means.

In any multi-stage residual oil hydrodesulfurization process, desulfurization severity is inherently greater in a second stage than in a first stage, and it is known that catalyst coking increases with desulfurization severity. Catalyst coking occurs so extensively in a second hydrodesulfurization stage that the second stage aging rate is considerably more rapid than the first stage aging rate. In prior art two-stage residual oil hydrodesulfurization processes with an interstage flash for removal of contaminant by-product gases, such as hydrogen sulfide, ammonia and gaseous hydrocarbons, and with progressively increasing temperatures in each stage to compensate for catalyst aging, it is commonly known that both the catalyst aging rate and coke formation on the catalyst is considerably greater in the second stage than in the first stage. This high second stage coking phenomenon can probably be explained on a molecular basis. In the first stage, the existence of peripheral alkyl groups on feed asphaltene and resin molecules provides steric hindrance which tends to prevent contact of the polycondensed ring inner body of the residual molecules with the catalyst. However, the most refractory sulfur in the asphaltene molecules is not removed in the first stage and must be removed in a second stage. This sulfur is more refractory because it tends to be deeply imbedded in the aromatic nucleus. Following the elimination of some of the alkyl groups in the first stage, the molecules entering the second stage are sterically better adapted to permit the aromatic nucleus to abut broadly against catalyst sites exposing the hydrogen and carbon atoms and ultimately the imbedded sulfur more intimately to the catalyst surface, thereby inducing coking. This mechanism probably accounts at least in part for the enhanced catalyst coking and higher aging rates in the second stage, as compared to the first stage.

Figure 2:
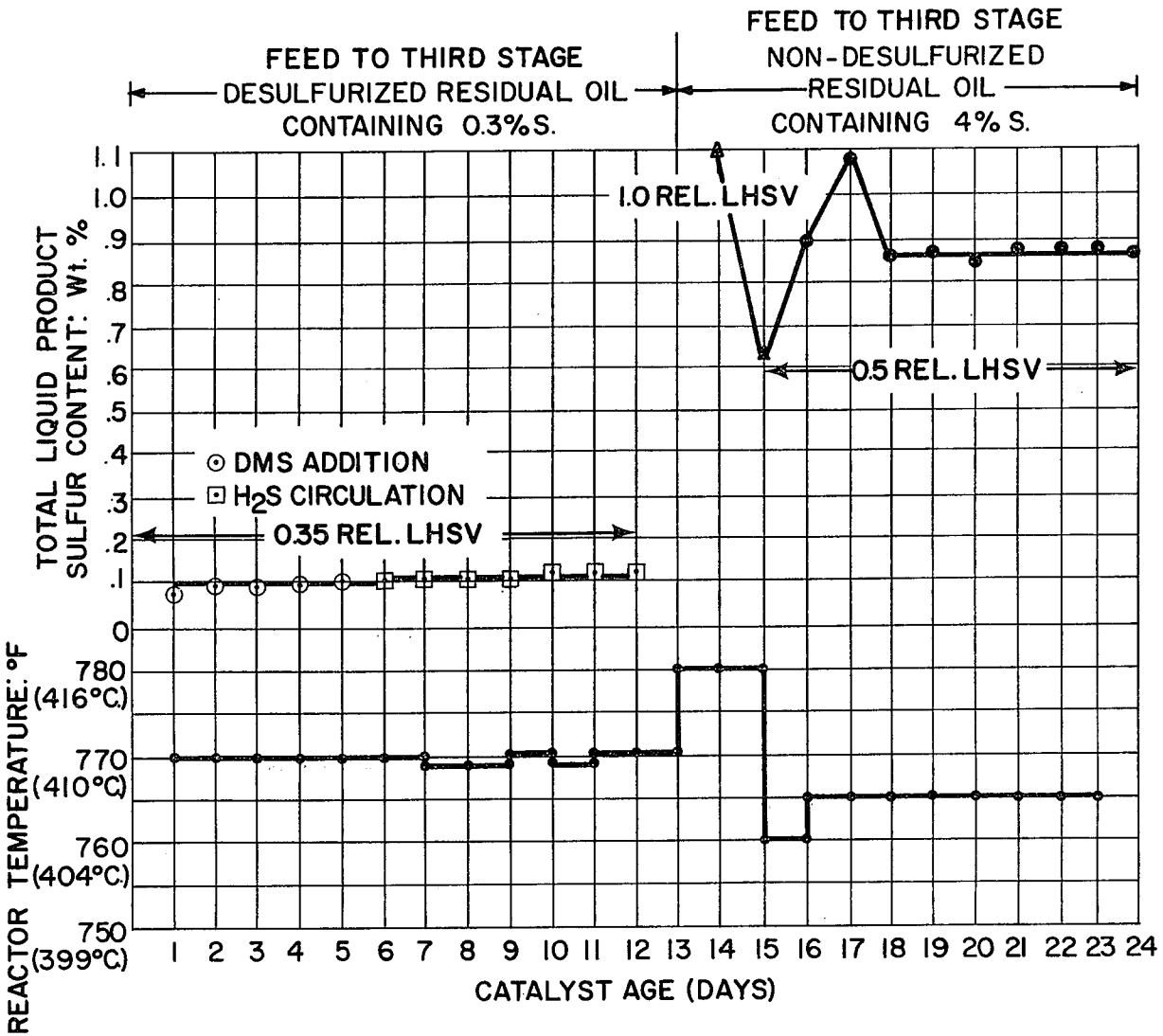
Figure 3:
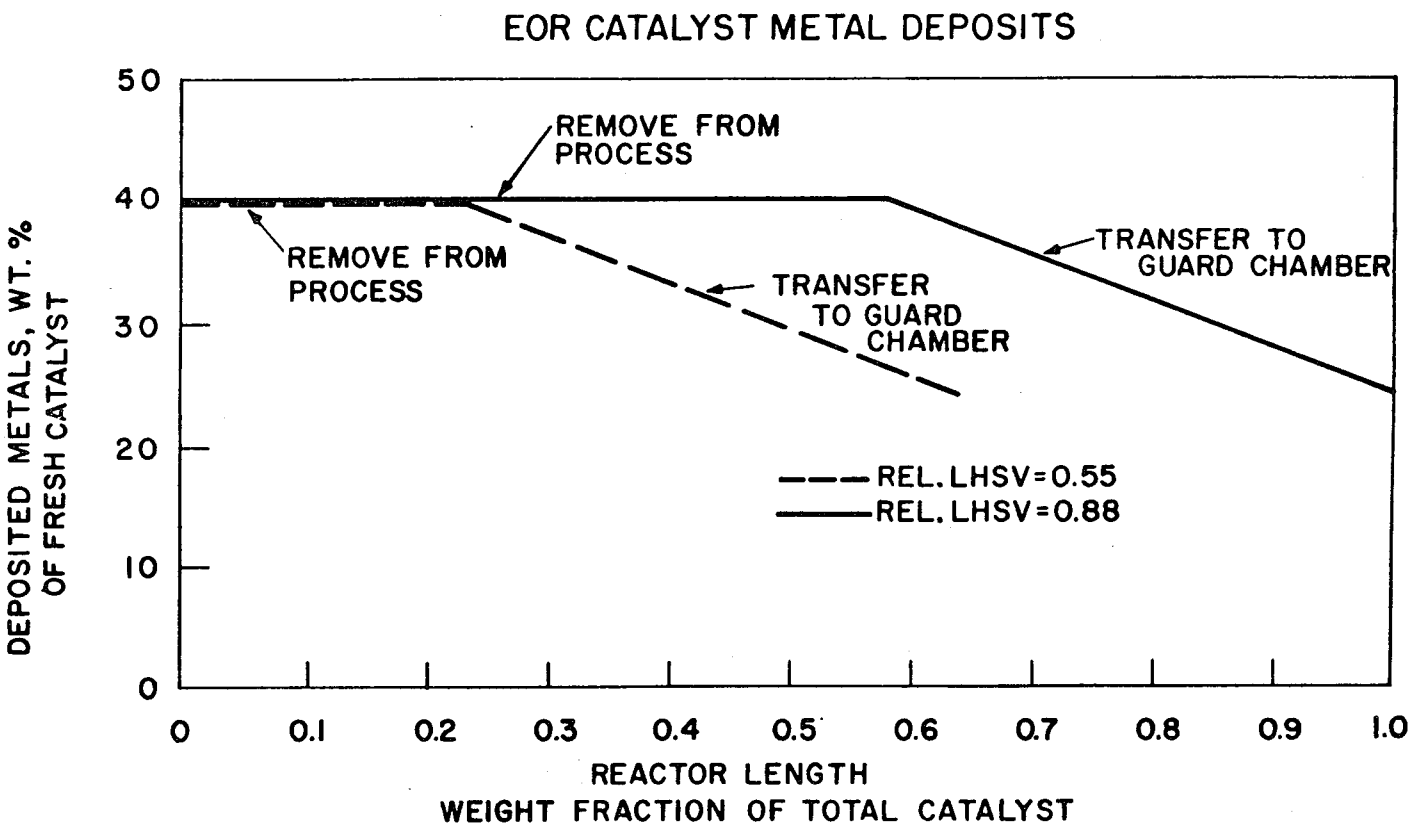
Figure 4:
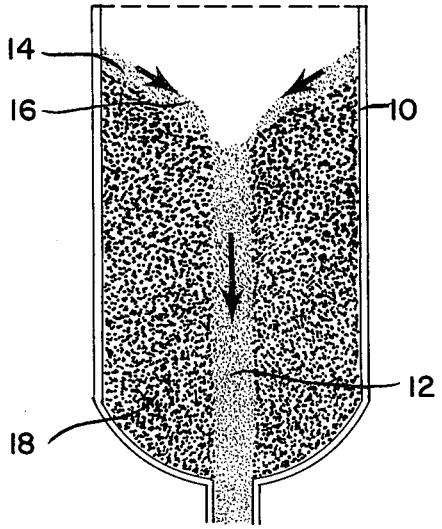
Figure 5:
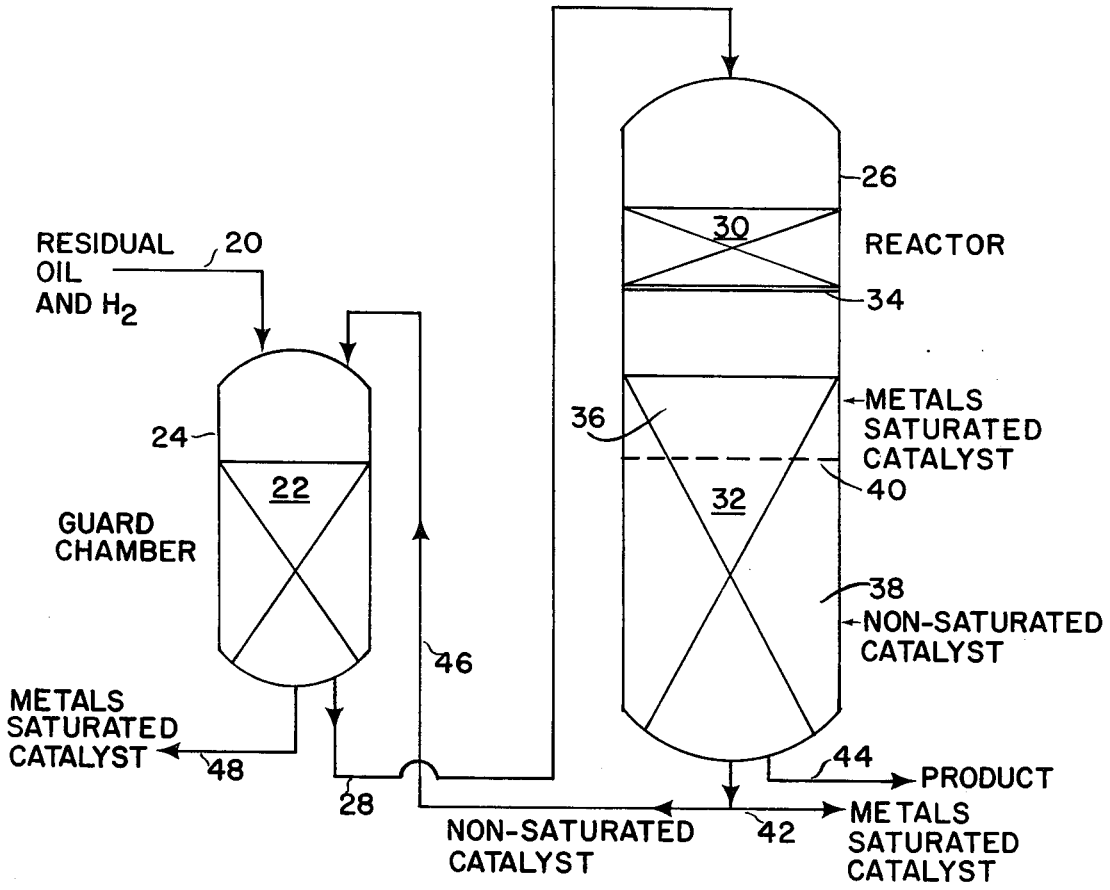

The concept of the present invention will be more fully appreciated by reference to the attached figures in which FIGS. 1 through 3 present graphs of data which illustrate the advantage of the invention, FIG. 4 illustrates a reactor emptying procedure and FIG. 5 illustrates a process scheme for performing this invention. FIG. 1 presents in detail a late stage petroleum residual oil hydrodesulfurization aging curve, specifically a third stage aging curve, using a nickel-cobalt-molybdenum on alumina catalyst. In the test illustrated in FIG. 1, although there was a flash step between the first and second stages, there was no flash step between the second and third stages. The stage represented in the data of FIG. 1 produced a product containing 0.11 weight percent sulfur from an effluent from a second stage containing 0.34 weight percent sulfur at 1850 psi (130 kg/cm$^2$) hydrogen pressure and 5,000 SCF/B (89 SCM/100L) of a stream containing 85 percent hydrogen. As shown in FIG. 1, due to rapid catalyst aging and rapid approach of the 790° F. (421° C.) reactor constraint temperature, process severity required incremental amelioration in order to keep the reactor in operation and avoid the constraint temperature as indicated by step-wise reductions in relative space velocity from 0.55 to 0.50, to 0.45, and to 0.40, while sulfur compounds were added in all but the first two space velocity intervals indicated in FIG. 1 to maintain the catalyst in a sulfided condition in the face of the low quantity of sulfur removed in the reactor. FIG. 1 shows that at the end of the aging period a relative space velocity of 0.50 was attempted, but at this space velocity at the last period in the catalyst cycle the constraint temperature had to be exceeded in order to produce the desired product sulfur level. Such a situation ordinarily requires termination of the catalyst cycle.

FIG. 2 represents an extension of the aging curve of FIG. 1. In order to attempt an extension of the life of the third stage catalyst, the relative LHSV was lowered drastically to 0.35 and dimethyl sulfide or hydrogen sulfide was added, permitting production of a 0.1 weight percent sulfur product at only 770° F. (371° C.). However, this space velocity was totally inadequate for processing a volume of oil as would be required with the reactor in series with earlier reactor stages. Thereupon, a non-desulfurized petroleum residual oil stream containing 4 weight percent sulfur which had constituted the feed to the first desulfurization stage was charged to the third stage. Initially, the non-desulfurized stream was introduced to a relative LHSV of 1.0, and a product sulfur level of 1.1 was obtained at 780° F. (416° C.). Since this temperature is close to the 790° F. (421° C.) constraint temperature, the LHSV was lowered to 0.5 and a product containing 0.86 percent sulfur was obtained at a reactor temperature of only 760° F. (404° C.). In this manner, the third stage reactor, after it was completely deactivated for third stage purposes, was found to be capable of desulfurizing the full flow of oil that had been charged to the first stage to obtain a product sulfur level which leveled out at less than the 1 percent sulfur level obtained from the first stage with the same feed. Furthermore, FIG. 3 shows that at a steady temperature of 765° F. (407° C.), which is well below the 790° F. (421° C.) metallurgical constraint temperature of the reactor, this surprising result is achieved with no catalyst aging during the period of the test even though the catalyst had previously been completely coke deactivated for purposes of standard third stage operation.

A possible theory relating to the data of FIG. 2 is that passage of fresh feed residual oil over a coke-deactivated catalyst in a downstream reactor induces a reduction of the equilibrium coke level on the downstream deactivated catalyst, even though there is no intervention of an oxidation or other type of catalyst regeneration step. At the same time, the present invention more fully achieves a fuller utilization of this downstream first stage catalyst for feed oil metals removal than would otherwise be possible.

The process of the present invention is operated under hydrogen pressures sufficiently great to induce deposition of most of the feed metals on a first stage catalyst disposed in a fixed bed of substantially stationary catalyst particles. At the hydrogen pressures employed, the metals laydown on the first stage catalyst is so rapid that the catalyst at the inlet region of the bed experiences a relatively great accumulation of metals, sometimes causing an encrustation or cementing effect at the very top of the bed, while the catalyst at progressively great depths in the first stage catalyst bed experiences progressively smaller accumulations of catalyst.

The data presented in Table 1 were taken in a test wherein 50 percent Kuwait reduced crude containing about 4 weight percent sulfur was passed downflow over a first stage fixed bed of nickel-cobalt-molybdenum on alumina hydrodesulfurization catalyst in the form of 1/32 inch extrudates at a hydrogen pressure of 1,850 psi (130 kg/cm$^2$), at temperatures of 675° to 800° F. (357° to 427° C.) and at a relative LHSV of 0.55.

The data illustrated in Table 1 were obtained by withdrawing segments or sections of first stage catalyst from a hydrodesulfurization reactor, and the measured percentage of the total catalyst in each section is indicated in Table 1. It is noted that the last four sections contain more than 46 weight percent of the total catalyst. Table 1 shows the amounts of nickel and vanadium in each of nineteen sections of catalyst. Table 1 further indicates the grouping of certain sections of the catalyst in Groups 1, 2 and 3, respectively, and describes certain occurrences in the catalyst system for testing purposes involving these groups after 156, 268 and 491 days, respectively.

TABLE 1

| Section No. | Section Weight % Of Total Catalyst | | Nickel | Vanadium | Total Ni + V | |
|---|---|---|---|---|---|---|
| | | | Weight % Based on Fresh Catalyst | | | |
| 1 | 1.65 | | 6.12 | 32.50 | 38.62 | Group 1 |
| 2 | 4.87 | | 7.01 | 38.95 | 45.96 | Removed and replaced |
| 3 | 2.26 | | 7.14 | 35.72 | 42.86 | by Group 2 after |
| 4 | 2.78 | | 7.29 | 35.52 | 42.81 | 156 days on stream. |
| 5 | 1.48 | | 5.20 | 26.83 | 32.03 | |
| 6 | 2.09 | | 11.10 | 35.59 | 46.69 | Group 2 |
| 7 | 3.04 | | 7.30 | 39.46 | 46.76 | Removed after 112 |
| 8 | 2.61 | | 6.25 | 31.24 | 37.49 | days on stream. |
| 9 | 3.83 | | 6.22 | 28.45 | 34.67 | Remainder of reactor |
| 10 | 1.48 | | 4.76 | 22.97 | 27.73 | cat. age 156+112 = 268 days. |
| 11 | 4.35 | | 8.02 | 36.81 | 44.83 | Group 3 |
| 12 | 4.26 | | 8.11 | 36.30 | 44.41 | Catalyst removed |
| 13 | 4.35 | | 7.26 | 31.39 | 38.65 | after 491 total days |
| 14 | 7.22 | | 8.36 | 36.34 | 44.71 | on stream. |
| 15 | 7.30 | | 7.99 | 33.20 | 41.19 | |
| 16 | 8.09 | | 6.50 | 26.20 | 32.70 | |
| 17 | 13.04 | | 7.64 | 29.81 | 37.45 | |
| 18 | 13.13 | 46.43% | 7.01 | 26.00 | 33.01 | |
| 19 | 12.17 | | 6.35 | 20.42 | 26.77 | |
| Total | 100.00 | | | | | |
| Weighted Average | | | 7.22 | 30.28 | 37.5 | |

As indicated in Table 1, after 156 days onstream, the reactor was shut down and the Section 1 through 5 increments of catalyst were removed overhead from the top of the catalyst bed and analyzed for nickel and vanadium content. The removed portions are identified as Group 1 increments in Table 1.

Thereupon, an equal amount of fresh catalyst was inserted into the reactor and operation of the reactor was continued for a period of 112 days. The fresh catalyst is indicated as Group 2 catalyst. At the end of this period, the Section 6 through 10 increments of catalyst, the topmost increments of catalyst in the bed, were removed through the top of the reactor and analyzed for nickel plus vanadium content. The analyses of the Group 2 increments are shown in Table 1.

The process was again restarted, this time without replacing the removed Group 2 catalyst. Operation was continued for another 223 days, so that the Group 3 catalyst, which is all the catalyst remaining in the reactor during this period, experienced a total aging period of 491 days onstream. After these final 223 days of operation, the reactor was shut down and the Section 11 through 19 increments, comprising the Group 3 increments, were withdrawn overhead and analyzed for nickel and vanadium content.

The data in Table 1 show that for Groups 1, 2 and 3 catalysts the increments disposed at the bottom contain much less metals than the increments disposed at the top, indicating that the catalyst at the bottom of each group retained significant remaining metals-holding capacity after the catalyst at the top of the same group experienced relatively complete metals saturation. This indicates that the process pressure was sufficiently high that the feed oil was substantially completely demetallized before it reached the bottom of the catalyst bed. As shown in Table 1, the top four increments of catalyst in Group 1 contained high levels of nickel plus vanadium ranging from 38.62 to 42.86 percent, but the bottommost increment contained only 32.03 percent of nickel plus vanadium indicating that the bottommost increment had significant remaining metals-holding capacity. Similarly, of the Group 2 increments, the top three portions contained relatively high levels of nickel plus vanadium, ranging from 37.49 to 46.76 percent, while the bottom two portions contained only 27.73 and 34.67 percent. Finally, Table 1 shows that the top five Group 3 increments contained a relatively high level, ranging from 38.65 to 44.83 percent of nickel plus vanadium, while the bottom four increments of Group 3 contained only 26.77 to 37.45 percent. But the important showing relating to Group 3 is that the bottom four increments of catalyst in Group 3 containing the relatively low content of nickel plus vanadium comprise a total of 46.43 percent of the total catalyst in the bed. Therefore, Table 1 shows that 46.43 percent of the total catalyst bed contains only 26.77 to 37.45 percent of nickel plus vanadium and further shows that one increment of catalyst in the bed contained as much as 46.76 percent of nickel and vanadium. This indicates that the 46.43 percent of the catalyst bed holding only 26.77 to 37.45 percent of nickel plus vanadium is theoretically capable of retaining at least 46.76 percent of these metals so that almost half of the catalyst, residing in the bottom of the bed, has a capacity for supporting over a third again more metals than it actually retains.

FIG. 3 presents the results of tests similar to the tests of Table 1, except that the results are presented in the form of a graph. FIG. 3 illustrates the results of two Kuwait 650° F.+ (343° C.+) atmospheric tower bottoms hydrodesulfurization catalyst aging tests for reducing feed oil sulfur content from 4 to 1 weight percent at relative liquid hourly space velocities of 0.64 and 1.0, respectively. In the graph of FIG. 3, a metals-saturated catalyst comprises 40 percent of fresh catalyst weight. FIG. 3 shows that at a relative LHSV of 0.55 only 23 percent of the catalyst was saturated with nickel plus vanadium deposited from the feed oil, while at a relative LHSV of 0.88 only 56 percent of the catalyst was saturated with feed metals. The various notations to the graphs in FIG. 3 are discussed below.

Table 2 illustrates a discovery that a well-defined solids flow mechanism can be employed for purposes of the present invention to separate catalyst which is relatively saturated with metals from catalyst which is relatively non-saturated with metals. The catalyst samples for all the data of Table 1 were obtained by lifting successive increments of catalyst from the top of a first stage reactor at the completion of a test period. However, this is an inefficient method for removal of the large quantities of catalyst contained in a commercial reactor since it involves the descent of workers into a manhole at the top of a commercial reactor at EOR wherein they are not only subjected to toxic reactor fumes but also must expend considerable labor to lift the catalyst from the reactor. To avoid these difficulties, the seventeen indicated catalyst increments withdrawn in the Table 2 data were obtained by opening a plug near the center of a dish-shaped or concave bottom of a reactor vessel and allowing the catalyst particles resting directly on the bottom of the reactor to flow vertically downwardly through the open plug. As indicated in Table 2, two-thirds of the total catalyst rested on the bottom of the reactor, while the one-third of the catalyst at the top of the reactor rested on an overhead shelf and therefore could not be removed by gravity flow through the bottom of the reactor, but had to be removed overhead. Any encrustation of the catalyst by heavy metals deposition and coke was limited to catalyst resting on the overhead shelf so that the two-thirds of the total catalyst which was removed through the bottom plug was in the form of free-flowing granules.

TABLE 2

| Reactor Bed | Equal Increments Withdrawn | % Ni + V Based on Fresh Catalyst |
|---|---|---|
| | 1 | 10.6(core of funnel) |
| | 2 | 20.2 |
| | 3 | 24.4 |
| Bottom Two-Thirds of Catalyst (resting on the concave bottom of the reactor at the plug) | 4 | 24.5 |
| | 5 | 21.8 |
| | 6 | 21.0 |
| | 7 | 18.2 |
| | 8 | 15.8 |
| | 9 | 12.0 |
| | 10 | 9.6 |
| | 11 | — |
| | 12 | 15.68 |
| | 13 | 10.61 |
| | 14 | 9.1 |
| | 15 | 8.96 |
| | 16 | 6.8 |
| | 17 | 5.75 |
| Top One-Third of Catalyst (resting on a top reactor shelf) | | 34.2 |

Before the data of Table 2 were obtained, because catalyst removal occurred from the bottom of the vessel it was expected that the increments obtained would represent a stream being supplied initially by catalyst originating at the bottom of the bed and then supplied by catalyst originating at adjacent successively higher layers of the catalyst bed, with the final increment representing the top layer of catalyst in the bed. This expectation was reinforced by the relatively low nickel plus vanadium content of the first catalyst increment obtained. However, the immediately subsequent catalyst increments withdrawn showed a steep rise in nickel plus vanadium content, and the nickel plus vanadium levels in the successive increments rose to a peak and ultimately declined, so that the final catalyst increments exhibited relatively low levels of nickel plus vanadium.

The observed profile of nickel plus vanadium content in the catalyst increments removed through the bottom plug of the reactor as shown in Table 2 occurs because of the development of a funnel flow mechanism as the catalyst granules flow freely from the bottom bed in the reactor through the open bottom plug. This invention utilizes the discovery that the funnel flow mechanism provides a precise method for accomplishing an abrupt separation of high nickel and vanadium catalyst from low nickel plus vanadium catalyst. This mechanism is illustrated in FIG. 4 which illustrates the removal of a granular catalyst at EOR from a reactor 10 in which the catalyst fills the entire cross-section of a cylindrical reactor vessel so that the reactor itself does not have the configuration of a funnel. Therefore, the full cylindrical cross-section of the reactor is utilized for catalyst fill. As indicated in FIG. 4, the first increment of catalyst removed on opening the bottom plug represents a column of granular catalyst starting at the plug and extending to the top of the bed. Since this first increment includes catalyst from the bottom of the bed, its nickel plus vanadium content is relatively low. However, once the center column is removed, there exists a hollowed or dilute phase central core 12 extending through the entire height of the catalyst bed. This core is maintained throughout the catalyst emptying operation so that catalyst from the top of the bed falls into the core whereby the catalyst at the top of the bed plus the core is contoured to resemble a funnel 16. Immediately after formation of the core, the removed catalyst is derived from the top 14 of the bed, accounting for the high nickel plus vanadium levels of the catalyst increments obtained immediately after the core is formed. Subsequent catalyst removed from the bed slides down the taper at the top of the funnel so that the locus of the taper progressively descends toward the bottom region 18 of the bed where the nickel plus vanadium laydown on the catalyst is low. This is the reason that the final catalyst increments removed through the plug have the lowest nickel plus vanadium levels.

This funnel catalyst outflow mechanism occurring upon gravity flow of catalyst particles from a reactor can be utilized for abruptly and precisely segregating relatively low metals catalyst from relatively high metals catalyst in a spent catalyst bed by fully emptying the reactor of the catalyst resting on the bottom thereof following termination of the catalyst cycle due to catalyst deactivation. The mechanism offers a convenient segregation method that can be applied to separation in a precise manner of catalyst granules of a relatively high nickel plus vanadium level from granules of a relatively low nickel plus vanadium level in a total bed of granules resting directly on the bottom of a reactor when the top of the catalyst bed is not encrusted due to high metals deposition. The method involves in a preferred embodiment utilizing a shelf at the top of the reactor on which is disposed a minor portion of the catalyst, above and apart from the major portion of the catalyst. Thereby, when the reactor plug at the bottom of the reactor is first opened, the first catalyst removed is from a relatively upper layer of the catalyst bed. This catalyst is high in metals and should be removed from the process, while segregating and retaining for use in a guard chamber the last removed catalyst which is from a portion of the catalyst disposed below said upper layer. This funnel flow procedure for catalyst removal affords a convenient and rapid means for efficient segregation of a low nickel and vanadium catalyst portion of a free-flowing granular catalyst bed from the remainder of the catalyst bed.

In accordance with the present invention, the low-metals catalyst thus segregated is transferred to a guard chamber wherein it is contacted with fresh feed oil, preferably until it reaches substantially its full metals holding capacity. No regeneration step to burn carbon from the catalyst being transferred to the guard chamber is required. The reason is that the data illustrated in FIG. 2 indicates that the fresh feed entering the guard chamber is likely to induce a new and lower equilibrium coke level on the transferred catalyst.

In obtaining the data of Table 2, the one-third of the catalyst disposed on the top shelf of the reactor was removed in a single batch without segregation into increments. As shown, the nickel and vanadium level of catalyst at the top of the reactor is substantially higher than in the catalyst removed from the bottom of the reactor and, because of its high metals content, is subject to encrustation which can inhibit free flow. The funnel flow method is seen to be suited for use in a reactor wherein a free-flowing bed which rests directly on the bottom of the reactor contains layers of catalyst having differing levels of deposited metals along the bed depth, wherein the highest nickel and vanadium catalyst regions are at the top of the bed and the lower nickel and vanadium catalyst levels are at the bottom of the bed.

The data of Table 2 illustrate a further advantage of the present invention. As shown in Table 2, the nickel plus vanadium levels of the catalyst from the top bed of the reactor is 34.2 percent, while the nickel plus vanadium level in all increments of the catalyst in the bottom of the bed is much lower. Since only one-third of the catalyst contained as much as 34.2 percent of nickel plus vanadium, the amount of catalyst containing a high metals level is usually not sufficiently great to warrant a commercial metals recovery operation. However, if at least a portion of the larger mass of catalyst contained in the bottom of the bed is passed to a guard chamber to elevate its level of deposited nickel plus vanadium, the total quantity of high metals catalyst could be sufficient to warrant a commercial metals recovery operation. If commercial recovery of metals is rendered economic in this manner, both the catalytic metals and oil-deposited metals contained on deactivated catalyst might be reclaimed. Reclaiming and industrial recycle of the metals could circumvent a considerable ecological problem relating the disposal of the catalyst by burial in the earth. An ecological problem in such burial can arise because the hydrogen sulfide in the hydrodesulfurization reaction atmosphere maintains the catalytic metals in a sulfided state so that disposal of deactivated catalysts in the earth can cause sulfur acid pollution of streams of the type that occurs in some coal strip mining operations.

Referring again to FIG. 3, the two graphs of this figure are each labeled to indicate a metals-saturated catalyst segment and a non-metals-saturated catalyst segment, with a catalyst wherein metals-saturation occurs when deposited metals comprise 40 percent of the fresh catalyst weight. The greater the total oil flow over the catalyst, the greater the relative size of the metals-saturated segment. The labels in FIG. 3 indicate that for each graph the metals-saturated segment is removed from the process while the non-saturated segment is transferred to a guard chamber. FIG. 5 presents a process scheme embodying the performance of these operations.

As shown in FIG. 5, residual oil and hydrogen entering through line 20 are passed downwardly through a fixed bed 22 of stationary catalyst particles in guard chamber 24. The catalyst in bed 22 is obtained from main reactor 26 in the manner indicated below.

Guard chamber effluent oil and hydrogen pass through line 28 without any flashing or other step for removal of contaminants to main reactor 26 wherein they flow downwardly through fixed beds 30 and 32, each bed comprising packed stationary catalyst particles. Catalyst bed 30 rests upon a shelf 34 which permits passage of oil and hydrogen therethrough, while supporting the small bed above and apart from the larger catalyst bed 32. Bed 30 may be subjected to encrustation with metals and is utilized to protect the top of lower bed 32 from such encrustation.

Although lower catalyst bed 32 is thereby protected from encrustation due to metals-deposition, an upper portion 36 of the bed, above dashed line 40, becomes substantially saturated with deposited metals without being encrusted. Catalyst portion 36 corresponds with the horizontal metals saturation line region of the graphs in FIG. 3. The lower catalyst region 38 of catalyst bed 32 is not saturated with metals and corresponds with the inclined regions of the graphs shown in FIG. 3. The position of dashed line 40, indicating the deepest or EOR penetration of metals saturated catalyst in bed 32 will depend upon the weight hourly space velocity employed, as is illustrated in FIG. 3, with the higher space velocity values resulting in the deeper penetration of the metals saturation line 40 into the catalyst bed. The temperature in main reactor 26 is increased during the run to compensate for catalyst activity aging loss, which corresponds at least in part to the penetration of dashed line 40 into the catalyst bed.

During the run, product is removed through line 44. At EOR, which is the time the reaction temperature has been elevated to the process constraint temperature, because the catalyst in bed 32 is not encrusted, it is free-flowing under the influence of gravity and is easily removable from the bottom of reactor 26. Upon opening a plug in the bottom of the reactor, a funnel develops in the outflowing catalyst granules so that the initially removed catalyst comprises metals-saturated top catalyst layer 36, which is removed from the process through line 42. Because of the funnel flow phenomenon, the last removed catalyst comprises non-saturated lower catalyst layer 38. This is the only catalyst portion capable of accommodating substantial additional metals. Therefore, the previous catalyst bed 22 is removed from guard chamber 24 through line 48 and lower catalyst layer 38 is then passed to the guard chamber through line 46. In this manner, non-saturated catalyst layer 38 replaces the previous fill of metals-saturated catalyst in guard chamber 24 and can provide one or a plurality of refills for the guard chamber 24. The metals-saturated catalyst removed through lines 44 and 48 are each rich with deposited nickel and vanadium in addition to their original catalytic metals, the metals being in a sulfided state. These catalyst streams can be combined and processed for recovery of metals thereon.

All or a portion of the non-saturated catalyst passing through line 46 is transferred directly to guard chamber 24 without any intermediate oxidation or other regeneration step for the removal of carbon therefrom. Advantageously, disposition of the transported catalyst in guard chamber 24 provides for contact of this catalyst with fresh feed oil and, as shown above, the fresh feed oil may achieve a new and lower equilibrium coke level on the catalyst as compared with the coke level on the catalyst at the bottom of the main reactor whereat it was removing more refractory sulfur from oil stream.

The process of FIG. 5 utilizes the discovery illustrated in FIG. 3 that the catalyst in bed 32 does not accept metals uniformly. Instead, an upstream portion of the catalyst in bed 32 becomes essentially metals saturated, while a separate and distinct downstream portion is still unsaturated. This observation permits the advantageous process feature that only a portion of the catalyst in the main reactor need be transported to guard chamber 24 in order to accomplish metals-saturation of all the catalyst of bed 32, thereby alleviating catalyst-handling problems and permitting guard chamber 24 to be considerably smaller in size than main reactor 26. Furthermore, full metals saturation of all the catalyst in bed 32 is easily facilitated by utilizing the gravity funnel-flow phenomenon which is observed when emptying reactor 26 of its granular catalyst. By utilizing the funnel-flow phenomenon the catalyst portions in bed 32 are not mixed. Upon emptying the reactor under the funnel-flow effect the catalyst segments 36 and 38 are sharply segregated and the only segment passed to the guard chamber is the non-saturated catalyst.

The proportion of the second stage catalyst transferred to the guard chamber can vary within wide limits. For example, between 10 and 80 weight percent, generally, or between 15 and 75 weight percent, preferably, of the second stage catalyst can be transferred to the guard chamber. Thereby no further handling of the saturated catalyst segment 36 is required and catalyst segment 36 can be removed from the process. The present process is therefore sharply distinguished from a fluid bed operation wherein catalyst flows countercurrent to the oil from a downstream reactor to an upstream reactor, because in fluid bed operation the agitation required for fluidization causes the catalyst particles in a reactor to be uniformly admixed to achieve an average metals saturation level so that all the catalyst, rather than only a selected portion, would have to be transported to an upstream reactor if full catalyst metals-saturation were to be achieved.

After reactor 26 is refilled with fresh catalyst and guard chamber 24 is filled with catalyst from reactor 26, the process can be restarted and the described cycle repeated.

Certain variations of the disclosed process will be apparent. For example, the guard chamber catalyst can be obtained for any downstream reactor of a multi-stage reactor system. Also, the used catalyst can be screened prior to loading in the guard chamber to remove any trapped intraparticulate matter or any broken pieces of catalyst which might unnecessarily increase pressure drop in the guard chamber.

We claim:

1. A process for hydrodesulfurization of a metal- and sulfur-containing residual oil comprising passing said oil and hydrogen downwardly through both a guard chamber and a reaction zone in series at a temperature in the range of 600° to 900° F. and a hydrogen pressure of 500 to 5,000 psi, said guard chamber and reaction zone each containing a fixed bed of hydrodesulfurization catalyst granules comprising supported Group VI-B and Group VIII metals, terminating the catalyst cycle while the upper portion of the catalyst in the reaction zone has a relatively high level of metals deposits and the lower portion of the catalyst in the reaction zone has a relatively low level of metals deposits, removing deactivated catalyst from the guard chamber, removing the catalyst from said reaction zone by gravity funnel flow through a bottom opening of the reaction zone so that said upper portion of the catalyst is removed before said lower portion and separated therefrom by discharging said upper portion of the catalyst from said process, passing at least a part of said lower portion of catalyst to said guard chamber, inserting fresh catalyst in said reaction zone, and resuming passage of residual oil and hydrogen downwardly through said guard chamber and reaction zones in series.

2. The process of claim 1 including a separate overhead catalyst bed in said reaction zone.

3. The process of claim 1 including the step of combining said catalyst removed from the guard chamber and said upper catalyst portion of the reaction zone, and recovering deposited metals from said combined catalyst.

4. The process of claim 1 wherein the catalyst removed from said guard chamber is substantially saturated with deposited metals.

5. The process of claim 1 wherein said lower catalyst portion is transferred to the guard chamber without a regeneration step.

6. The process of claim 1 wherein at least 70 percent of the total product boils above the initial boiling point of said residual oil.

* * * * *